US007833683B2

(12) United States Patent
Yanus et al.

(10) Patent No.: US 7,833,683 B2
(45) **Date of Patent: *Nov. 16, 2010**

(54) PHOTOSENSITIVE MEMBER HAVING AN OVERCOAT

(75) Inventors: John F Yanus, Webster, NY (US); Kenny-Tuan Dinh, Webster, NY (US); Markus R Silvestri, Fairport, NY (US); Dale S Renfer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 585 days.

This patent is subject to a terminal disclaimer.

(21) Appl. No.: 11/838,789

(22) Filed: Aug. 14, 2007

(65) Prior Publication Data

US 2009/0047588 A1 Feb. 19, 2009

(51) Int. Cl.
*G03G 15/02* (2006.01)

(52) U.S. Cl. ..... 430/57.1; 430/66

(58) Field of Classification Search ..... 430/57.1, 430/66

See application file for complete search history.

(56) References Cited

U.S. PATENT DOCUMENTS 7,122,283 B2 * 10/2006 Qi et al. ..... 430/58.2
7,384,717 B2 * 6/2008 Dinh et al. ..... 430/66
7,592,110 B2 * 9/2009 Dinh et al. ..... 430/58.2

* cited by examiner

*Primary Examiner*—Hoa V Le
(74) *Attorney, Agent, or Firm*—Pillsbury Winthrop Shaw Pittman LLP

(57) ABSTRACT

An imaging member including a substrate; a charge generation layer; a charge transport layer containing a mixture including a polymer and charge transport components, wherein the mixture has a glass transition temperature of less than about 70° C.; and an overcoat having a crosslinked polymer network including a resin, charge transport molecules, crosslinking component, an acid catalyst and an optional low surface component, and wherein the resin is a resin selected from the group consisting of polyester and polyol resins, and further wherein the resin has crosslinking sites selected from the group consisting of hydroxyl and carboxy groups.

13 Claims, 1 Drawing Sheet

PHOTOSENSITIVE MEMBER HAVING AN OVERCOAT

BACKGROUND

Herein are disclosed photosensitive members (also know as photoreceptors, photoconductors, and the like) useful in electrostatographic apparatuses, including printers, copiers, other reproductive devices, and digital apparatuses. In specific embodiments, the photoreceptors comprise a relatively soft charge transport layer comprising a low glass transition temperature (Tg) charge transport layer polymer, and thereover, a relatively hard overcoat comprising a crosslinked polymer matrix. In embodiments, the use of the combination of charge transport layer and overcoat allows for a reduction or elimination of curl sometimes caused by the thermal expansion in belt photoreceptors.

Electrophotographic imaging members, including photoreceptors or photoconductors, typically include a photoconductive layer formed on an electrically conductive substrate or formed on layers between the substrate and photoconductive layer. The photoconductive layer is an insulator in the dark, so that electric charges are retained on its surface. Upon exposure to light, the charge is dissipated, and an image can be formed thereon, developed using a developer material, transferred to a copy substrate, and fused thereto to form a copy or print.

Belt or web photoreceptors have reoccurring problems with the anti-curl back coating (ACBC) present on the belt or web photoreceptors. Due to differential thermal coefficients of expansion, the various layers necessary to produce a functioning photoreceptor cause a distinct upward curl when coated on some substrate materials, such as polyterephthalate (e.g., MYLAR®, MELINEX® and the like). To counter this problem, an additional layer of sufficient thickness is applied to the photoreceptor backside rendering the photoreceptor flat.

Several photoreceptor designs have been proposed over the years to eliminate curl Prominent among potential solutions is to use a charge transport layer having a transition temperature at or below that of the operating temperature. Materials that have been used in the past include long chain ester derivatives of tetraphenyl benzidines, tritolyamine, plasticizers, and certain siloxane copolymers. These photoreceptors did not function sufficiently as a useful photoreceptor belt due to the soft and tacky nature of the layer. Further, low transition temperature materials can be easily abraded. In addition, a tacky surface can act as a toner adhesive leading to problems with printing and copying, and contamination of other system components.

Therefore, there exists a need in the art for an improved photoreceptor. Desired is a photoreceptor having a reduced curl. In addition, it is desired to provide a photoreceptor that is not easily abraded. It is also desired to provide a photoreceptor that does not have a tacky surface so as not to act as a toner adhesive.

SUMMARY

Embodiments include an imaging member comprising: a substrate; a charge generation layer; a charge transport layer comprising a mixture comprising a polymer and charge transport components, wherein the mixture has a glass transition temperature of less than about 70° C.; and an overcoat comprising a crosslinked polymer network comprising a resin, charge transport molecules, an acid catalyst, crosslinking component, and an optional low surface component, and wherein the resin is a resin selected from the group consisting of polyester and polyol resins, and further wherein the resin has crosslinking sites selected from the group consisting of hydroxyl and carboxy groups.

Embodiments further include an imaging member comprising: a flexible belt substrate; a charge generation layer; a charge transport layer comprising a mixture comprising a polymer and charge transport components, wherein the mixture has a glass transition temperature of less than about 70° C.; and an overcoat comprising a crosslinked polymer network comprising a resin, alcohol soluble charge transport molecules, acid catalyst, crosslinking component, and an optional low surface component, and wherein the resin is a resin selected from the group consisting of polyester and polyol resins, and further wherein the resin has crosslinking sites selected from the group consisting of hydroxyl and carboxy groups.

In addition, embodiments include an image forming apparatus for forming images on a recording medium comprising: a) an imaging member comprising: a flexible belt substrate; a photogenerating layer; a charge transport layer comprising a mixture comprising a polymer and charge transport components, wherein the mixture has a glass transition temperature of less than about 70° C.; and an overcoat comprising a crosslinked polymer network comprising a resin, charge transport molecules, an acid catalyst, crosslinking component, and an optional low surface component, and wherein the resin is a resin selected from the group consisting of polyester and polyol resins, and further wherein the resin has crosslinking sites selected from the group consisting of hydroxyl and carboxy groups; b) a development component to apply a developer material to the charge-retentive surface to develop said electrostatic latent image to form a developed image on said charge-retentive surface; c) a transfer component for transferring the developed image from the charge-retentive surface to another member or a copy substrate; and d) a fusing member to fuse the developed image to the copy substrate.

BRIEF DESCRIPTION OF THE DRAWINGS

For a better understanding, reference may be had to the accompanying figures.

DETAILED DESCRIPTION

The present disclosure relates to a photoreceptor comprising an overcoat comprising a crosslinked polymer network comprising a resin, charge transport molecules, a crosslinking agent and low surface energy component, and in embodiments, these materials are all polymerized together under the influence of an acid catalyst. The low surface energy component is optional and is not useful for all applications due to toner variations in any case, the water contact angle for overcoat layers, in embodiments with is 103°, while known surfaces were shown to be 88° , and iGen3 (contains phenols) was shown to be 95°. Higher numbers for water contact angle means lower surface energy due to a greater mismatch of high tension water surface.

Figure 1:
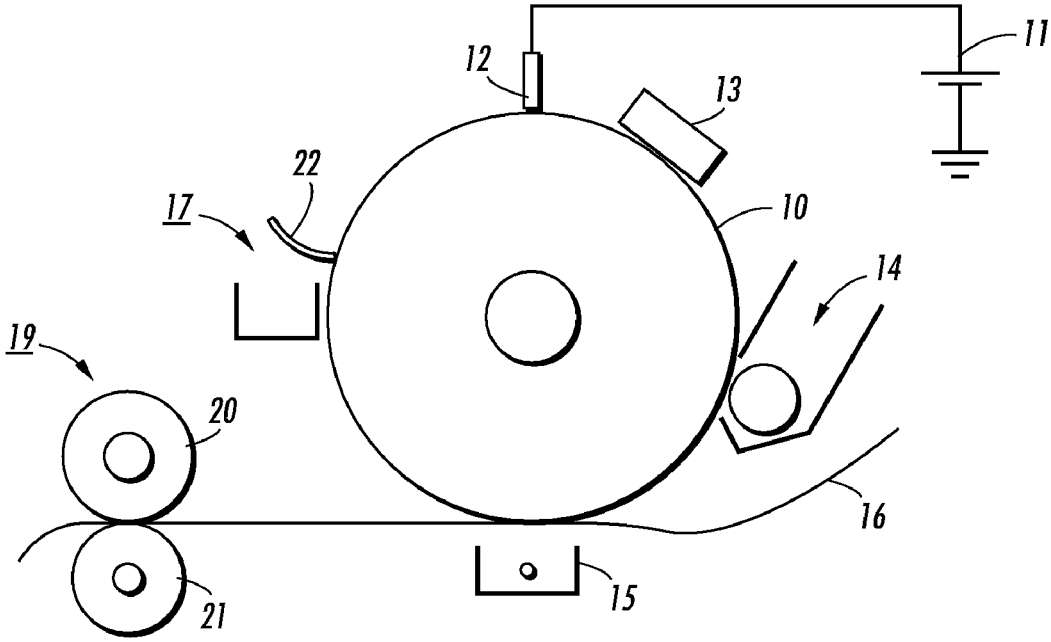
FIG. 1 is an illustration of a general electrostatographic apparatus using a photoreceptor member.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner. Specifically, photoreceptor 10 is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
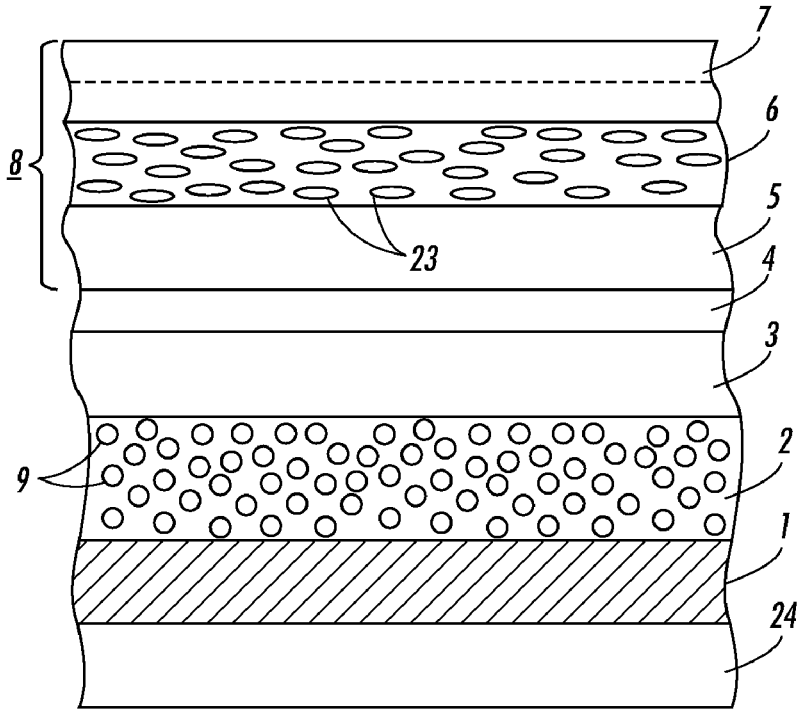
FIG. 2 is an illustration of an embodiment of a photoreceptor showing various layers and embodiments of filler dispersion.

Electrophotographic imaging members are well known in the art Electrophotographic imaging members may be prepared by any suitable technique. Referring to FIG. 2, typically, a flexible or rigid substrate 1 is provided with an electrically conductive surface or coating 2.

Substrate

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device. In embodiments, the substrate is a flexible belt.

In embodiments where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors. In embodiments, coating 2 is an electron transport layer discussed in detail below and may have filters 9 dispersed therein.

Optional Hole-Blocking Layer

An optional hole-blocking layer 3 may be applied to the substrate 1 or coatings. Any suitable and conventional blocking layer capable of forming an electronic barrier to holes between the adjacent photoconductive layer 8 (or electrophotographic imaging layer 8) and the underlying conductive surface 2 of substrate 1 may be used.

An anticurl backing layer 24 may be positioned on an underside of the substrate.

Optional Adhesive Layer

An optional adhesive layer 4 may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air-drying and the like.

Electrophotographic Imaging Layer

At least one electrophotographic-imaging layer 8 is formed on the adhesive layer 4, blocking layer 3 or substrate 1. The electrophotographic imaging layer 8 may be a single layer (7 in FIG. 2) that performs both charge-generating and charge transport functions as is well known in the art, or it may comprise multiple layers such as a charge generator layer 5 and charge transport layer 6 and overcoat 7.

Charge Generating Layer

The charge-generating layer 5 can be applied to the electrically conductive surface, or on other surfaces in between the substrate 1 and charge-generating layer 5. A charge-blocking layer or hole-blocking layer 3 may optionally be applied to the electrically conductive surface prior to the application of a charge-generating layer 5. If desired, an adhesive layer 4 may be used between the charge blocking or hole-blocking layer or interfacial layer 3 and the charge-generating layer 5. Usually, the charge generation layer 5 is applied onto the blocking layer 3 and a charge transport layer 6, is formed on the charge generation layer 5. This structure may have the charge generation layer 5 on top of or below the charge transport layer 6.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyaryisulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechtoride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent-coated layer may be effected by any suitable conventional technique such as oven drying, infrared radiation drying, air-drying and the like.

Charge Transport Layer

The charge transport layer 6 comprises a relatively low Tg composition. These charge transport layers can comprise 1) plasticizing charge transporting small molecules dispersed in polycarbonates that possess low glass transition temperatures (Tg), 2) conventional charge transport layers plasticized with solvents or additives, and 3) low glass transition polymers or copolymers binders containing conventional charge transporting small molecules dissolved or molecularly dispersed therein, and combinations thereof.

The charge transport layer (CTL) comprises a relatively soft photoactive layer comprising a low glass transition temperature (Tg) composition. Examples of suitable low Tg layers include those that relieve stress, and in embodiments, include charge transport molecules OPEC (N,N'-diphenyl-N,N'-bis3-[oxypentylethylcarboxylate]), phenyl-4,4'-biphenyl-1,1'diamine, tritolylamine, and the like, and low Tg binders such as plasticized polymers, siloxane copolymers, and the like, and mixtures thereof. Specific examples of commercially available polymers for the CTL include MAKROLON®, LEXAN®, and the like. The polymer of the CTL is dispersed in a dispersant selected from the group consisting of methylene chloride, dichlorobenzene, tetrahydrofuran, toluene and the like. Specific examples of the CTL include mTBD, and MAKROLON® (a polycarbonate from Bayer Material Sciences) in methylene chloride, and dichlorobenzene; tri-[4-methylphenyl]amine and MAKROLON® in methylene chloride; and OPEC [N,N'-diphenyl-N,N'-bis3-[oxypentylethylcarboxylate], phenyl-4,4'-biphenyl-1,1'diamine and MAKROLON® in methylene chloride.

The CTL is relatively soft and tacky, and has a Tg of less than about 70° C., or from about 20 to about 70° C., or from about 30 to about 60° C. The CTL has a thickness of from about 10 to about 40 microns, or from about 20 to about 30 microns.

Any suitable electrically inactive resin binder insoluble in the alcohol solvent used to apply the overcoat layer 7 may be employed in the charge transport layer. Typical inactive resin binders include polycarbonate resin, polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene) carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyldiphenyl) carbonate (also referred to as bisphenol-C-polycarbonate) and the like. Any suitable charge-transporting polymer may also be used in the charge-transporting layer. The charge-transporting polymer should be insoluble in the alcohol solvent employed to apply the overcoat layer. These electrically active charge transporting polymeric materials should be capable of supporting the injection of photogenerated holes from the charge generation material and be capable of allowing the transport of these holes there through.

Examples of some small molecules known to yield low transition temperature charge transport layers are enumerated in U.S. Pat. Nos. 5,698359, 5,728,498, 5,863,685, 6,028,702, 6,096,470, 6,099,996, the subject matter of which are hereby incorporated by reference in their entirety. Also, plasticized polycarbonates containing conventional charge transport molecules can be found in U.S. Pat. Nos. 5,698359, 5,728,498, 5,863,685, 6,028,702, 6,096,470, and 6,099,996, the subject matter of which are hereby incorporated by reference in their entirety. In addition, polycarbonate siloxane copolymers are described in U.S. Pat. No. 5,681,679, the subject matter of which is hereby incorporated by reference in its entirety.

The term "dissolved" as employed herein is defined as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. Any suitable charge transporting or electrically active small molecule may be employed in the charge transport layer. The expression charge transporting "small molecule" is defined herein as a monomer that allows the free charge photogenerated in the transport layer to be transported across the transport layer.

Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like.

As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material, or combinations of small molecules in polymers.

Charge transporting long chain alkyl ester group containing materials can also be represented by the following formula for aryl monoamines:

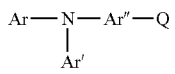

wherein:

Q is represented by the formula:

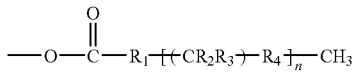

wherein:

$R_1$ and $R_4$ are independently:

$-(CH_2)_v-$ $R_2$ and $R_3$ are independently selected from the group consisting of:

$-H$, $-(CH_2)_v-CH_3$, $-CH(CH_3)_2$ and $-C(CH_3)_3$, wherein v is from about 1 to about 10, n is from about 0 to about 10, Ar" is

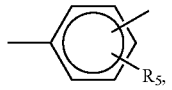

Ar is

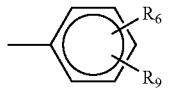

and

Ar' is selected from the group consisting of:

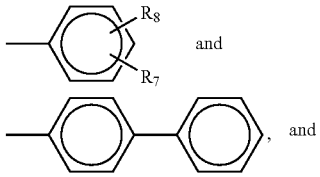

wherein $R_5$, $R_6$, $R_7$, $R_8$ and $R_9$ are independently selected from the group consisting of

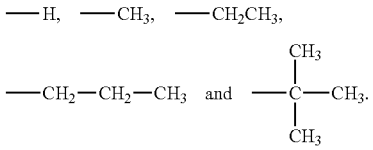

In embodiments, the arylamine attached to a long chain alkyl ester group can be a triphenylamine, e.g., N,N-bis[4-methylphenyl]-N-[3-phenyldecanoate]amine represented by the following formula:

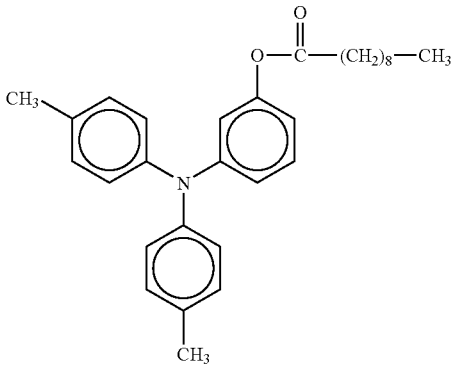

Other long chain triarylamine products containing a long chain alkyl ester group include, for example, N,N-diphenyl-N-[3-phenyldecanoate]amine, N-phenyl-N-[4-methylphenyl]-N-[3-phenyldecanoate]amine, N-phenyl-N-[3,4-dimethylphenyl]-N-[3-phenyldecanoate]amine, N,N-bis[3,4-dimethylphenyl]-N-[3-decanoatephenyl]amine, N,N-bis[4-methylphenyl]-N-[3-phenyidecanoate]amine, N-phenyl-N-[1-biphenyl]-N-[3-phenyldecanoate]amine, N-[4-methylphenyl]-N-[1-biphenyl]-N-[3-phenyidecanoate]amine, N-[3,4-dimethylphenyl]-N-[1-biphenyl]-N-[3-phenyidecanoate]amine, and the like. Similar products include the octanoates, dodecanoates and tetradecanoates of the above arylamines and the like.

Other examples of suitable hole transporting materials include aryldiamines containing at least two long chain alkyl carboxylate groups derived from a charge transporting reactant selected from the group consisting of tertiary amine-containing molecules which can be represented by the formula:

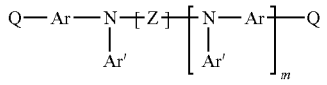

wherein m is 0 or 1; Z is selected from the group consisting of:

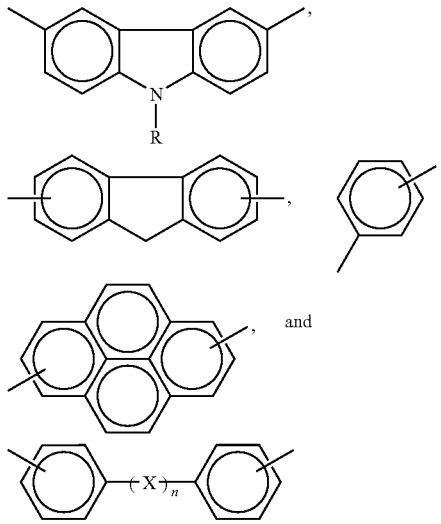

wherein n is 0 or 1; Ar is selected from the group consisting of:

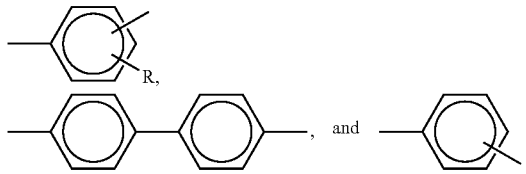

wherein R is selected from the group consisting of —$CH_3$, —$C_2H_5$, —$C_3H_7$, and —$C_4H_9$; Ar' is selected from the group consisting of:

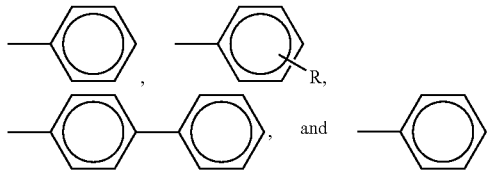

X is selected from the group consisting of:

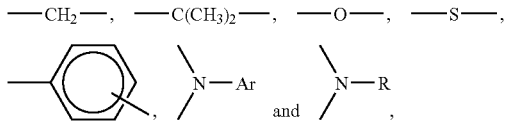

-continued

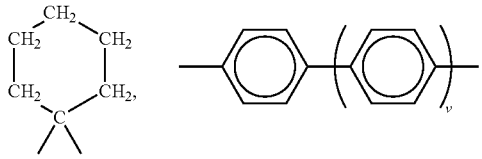

wherein v is 0, 1 or 2; and Q is represented by the formula:

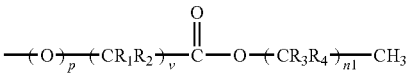

$R_1$, $R_2$, $R_3$, $R_4$ are independently selected from —H, —$CH_3$, —$(CH_2—)_v$—$CH_3$—$CH(CH_3)_2$, —$C(CH_3)_3$; v is from about 1 to about 10, and p and n1 are independently from about 0 to about 10.

Also, possible solvents include low volatility solvent such as those selected from the group consisting of monochlorobenzene, dichlorobenzene, trichlorobenzene, mixtures of any two of these solvents and mixtures of all three of these solvents.

Any suitable and conventional technique may be used to mix and thereafter apply the charge transport layer coating mixture to the charge-generating layer. Typical application techniques include spraying, dip coating, roll coating, wire wound rod coating, and the like. Drying of the deposited coating may be effected by any suitable conventional technique such as oven drying, infrared radiation drying, air-drying and the like.

In embodiments, the hole transport layer is an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

Overcoat

Over the CTL is a relatively tough overcoat layer comprising a crosslinked polymer network. The crosslinked polymer network comprises a resin and in embodiments a crosslinkable resin, and in embodiments a crosslinkable CTM, a crosslinking agent, an acid catalyst, and an optional low surface energy component. The term "crosslinkable" refers to molecules having active sites capable of reacting with a crosslinking agent. A crosslinking agent covers molecules which can react with active sites and bridge two or more polymer chains, and can be methoxy methylated melamine, quanamine, and mixtures thereof.

The overcoat is wear resistant, and in embodiments, is crosslinked. Suitable networks include polyol as the resin, methoxy methylated melamine as the crosslinking agent, dihydroxy TPD (DHTPD) as the charge transport molecule, and crosslinked resins thereof, and optional low surface energy additives, and optional acidic catalyst. Specific examples of commercially available polymer networks for the overcoat include 7558-B-60 (from OPO Polymers, Inc.), a crosslinking agent such as melamine, and quanamine derivatives such as CYMEL® (from Cytec Industries), and the like, The low surface energy component may be present in the overcoat in an amount of from about 0.1 to about 10 percent, or from about 1 to about 5 percent by weight of total solids, and is available from BYK Chemie as SILCLEAN® 3700 (hydroxy functionalized siloxane polyacrylate). The CTM of the overcoat can be selected from those listed above for the CTL. Examples of hydroxy functionalized siloxane polyacrylates are represented by at least one of $$[HO—[R]_a]—[SiR_1R_2—O—]_n—[[R]_a—OH]_b$$

where R represents an acrylate $$—CH_2CR_1—[CO_2R_3];$$

wherein "a" represents the number of repeating R units and is from about 1 to about 100, or from about 1 to about 50; and where $R_1$, $R_2$ and $R_3$ independently represent alkyl with from about 2 to about 20 carbons, or from about 2 to about 10 carbons; n is a number of from about 5 to about 200, or from about 5 to about 100; and b is 0 or 1;

$$HO—R_z—[SiR_1R_2—O—]_a—[R_z—OH]_b$$

where R, represents $$[—[CH_2]_w—O—]_p,$$

and w is from about 2 to about 10 or from about 2 to about 5; p is from about 1 to about 1500, or from about 1 to about 1,000; and where $R_1$ and $R_2$ independently represent alkyl with from about 2 to about 20 carbons, or from about 2 to about 10 carbons; a is from about 5 to about 200, or from about 5 to about 100; and b is 0 or 1;

$$HO—R_x—[SiR_1R_2—O—]_a—[R_x—OH]_b$$

where $R_x$ represents $$(—C—R_a—C)_m—(—CO_2—R_b—CO_2—)_n—(—C—R_c—C)_p—(—CO_2—R_d—CO_2—)_q$$

where $R_a$ and $R_c$, independently represent alkyl or a branched alkyl group derived from polyols; and having from about 1 to about 50 carbons; $R_b$ and $R_d$ independently represent an alkyl group derived from a polycarboxylic acid, which alkyl contains, for example, from 1 to about 20 carbon atoms; and m, n, p, and q represent mole fractions of from 0 to about 1, such that n+m+p+q=1; and where $R_1$ and $R_2$ independently represent alkyl with from about 2 to about 20 carbons; a is from about 5 to about 200, and b is from 0 to about 1.

The overcoat is relatively hard and rubbery and has a hardness of about 0.30 GPa by nanoindentation and the toughness of the layer is indicated by a large area beneath the stress-strain curve. Toughness relates to the resistance to impact. It is related to the area under a stress strain curve. The overcoat has a thickness of from about 1 to about 10 microns, or from about 2 to about 6 microns.

The overcoat components may be dissolved in any suitable secondary or tertiary, alcoholic solvent, for example, 1-methoxy-2-propanol, 2-propanol, 2-butano, tertiary butanol, mixtures thereof, and the like.

The CTL can be dried in a forced air oven at a temperature of from about 80 to about 140° C., or from about 110 to about 135° C., at a time of from about 2 to about 10 minutes, or from about 3 to about 5 minutes. When cool, the underlayer can be overcoated and dried at a temperature of from about 120 to about 150° C. or from about 125 to about 135° C., at a time of from about 1 to about 5 minutes, or from about 2 to about 3 minutes.

The crosslinking catalyst can be used in combination with the overcoat to promote crosslinking of the overcoat components. Typical catalysts include oxalic acid, p-toluene sulfonic acid, phosphoric acid, sulfuric acid and the like, and mixtures thereof. Catalysts can be used in an amount of from about 0.1 to about 20 percent, or from about 0.5 to about 3 percent, or about 1 to about 2 percent by weight of total polymer content.

Crosslinking components can be used in combination with the overcoat to promote crosslinking of the overcoat components, thereby providing a strong bond. Examples of suitable crosslinking agents include methoxy methylated melamine, quanamine, and the like, and mixtures thereof.

Examples of crosslinking components include a melamine compound represented by

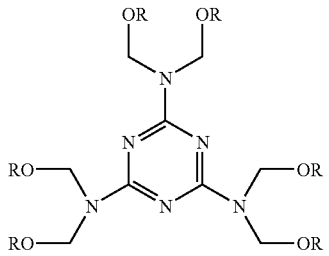

wherein R is selected from the group consisting of at least one of hydrogen, methyl, ethyl, propyl, and butyl, and a melamine formaldehyde resin represented by

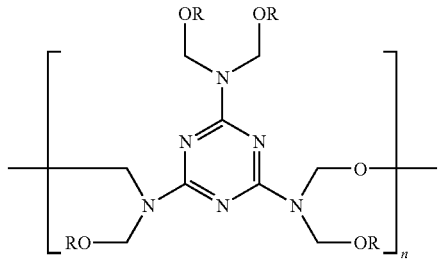

wherein R is selected from the group consisting of hydrogen, methyl, ethyl, propyl, butyl, and mixtures thereof; and n represents a number of repeating units of from about 1 to about 100.

Examples of charge transport small molecules useful in the overcoat formulations include dihydroxy TBD (DHTPD) N,N'-diphenyl-N,N'-bis(3-hydroxyphenyl)-[1,1'-biphenyl]-4,4'-diamine; N,N,N',N',-tetra(3-hydroxyphenyl)-[1,1'-biphenyl]-4,4'-diamine; N,N-di(3-hydroxyphenyl)-m-toluidine; 1,1-bis-[4-(di-N,N-m-hydroxyphenyl)-aminophenyl]-cyclohexane; 1,1-bis[4-(N-m-hydroxyphenyl)-4-(N-phenyl)-aminophenyl]-cyclohexane; bis-(N-(3-hydroxyphenyl)-N-phenyl-4-aminophenyl)-methane; bis[(N-(3-hydroxyphenyl)-N-phenyl)-4-aminophenyl]-isopropylidene; N,N'-diphenyl-N,N'-bis(3-hydroxyphenyl)-[1,1',4',1"-terphenyl]-4,4"-diamine; 9-ethyl-3,6-bis[N-phenyl-N-3(3-hydroxyphenyl)-amino]-carbazole; 2,7-bis[N,N-di(3-hydroxyphenyl)-amino]-fluorene; 1,6-bis[N,N-di(3-hydroxyphenyl)-amino]-pyrene; and 1,4-bis[N-phenyl-N-(3-hydroxyphenyl)]-phenylenediamine, and the like, and mixtures thereof.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Charge Transport Layer 1

An electrophotographic imaging member web stock was prepared by providing a 0.02 micrometer thick titanium layer coated on a biaxially oriented polyethylene naphthalate substrate (KADALEX®, available from ICI Americas, Inc.) having a thickness of 3.5 mils (89 micrometers) and applying thereto, using a gravure coating technique and a solution containing 10 grams gamma aminopropyltriethoxy silane, 10.1 grams distilled water, 3 grams acetic acid, 684.8 grams of 200 proof denatured alcohol and 200 grams heptane. This layer was then allowed to dry for 5 minutes at 135° C. in a forced air oven. The resulting blocking layer had an average dry thickness of 0.05 micrometer measured with an ellipsometer.

An adhesive interface layer was then prepared by applying with extrusion process to the blocking layer a wet coating containing 5 percent by weight based on the total weight of the solution, of a polyester adhesive (MOR-ESTER® 49,000, available from Morton International, Inc.) in a 70:30 volume ratio mixture of tetrahydrofuran:cyclohexanone. The adhesive interface layer was allowed to dry for 5 minutes at 135° C. in a forced air oven. The resulting adhesive interface layer had a dry thickness of 0.065 micrometer The adhesive interface layer was thereafter coated with a photogenerating layer. The photogenerating layer dispersion was prepared by introducing 0.45 grams of lupilon 200 (PC-Z 200) available from Mitsubishi Gas Chemical Corp and 50 ml of tetrahydrofuran into a 4 oz. glass bottle. To this solution was added 2.4 grams of hydroxygallium phthalocyanine and 300 grams of ⅛ inch (3.2 millimeter) diameter stainless steel shot. This mixture was then placed on a ball mill for 20 to 24 hours. Subsequently, 2.25 grams of PC-Z 200 were dissolved in 46.1 gm of tetrahydrofuran, then added to this OHGaPc slurry. This slurry was then placed on a shaker for 10 minutes. The resulting slurry was, thereafter, coated onto the adhesive interface by an extrusion application process to form a layer having a wet thickness of 0.25 mil. However, a strip about 10 mm wide along one edge of the substrate web bearing the blocking layer and the adhesive layer was deliberately left uncoated by any of the photogenerating layer material to facilitate adequate electrical contact by the ground strip layer that is applied later. This photogenerating layer was dried at 135° C. for 5 minutes in a forced air oven to form a dry thickness photogenerating layer having a thickness of 0.4 micrometers.

Example 2

Charge Transport Layer 2

In a 1-ounce bottle was placed 1.3 grams of MAKROLON® polycarbonate from Bayer, and 11 grams of methylene chloride. The contents were agitated until fully dissolved. To the solution was added 1.3 grams N,N'-diphenyl-N,N-bis(3-methylphenyl)-1,1'-biphenyl-4,4'-diamine and 0.8 grams 1,2,4-trichlorobenzene. The contents were agitated until fully dissolved. Using a member from Example 1, the solution was coated onto the charge-generating layer using a 4 mil Bird bar. The layer was dried at 100° C. for 2 minutes in a forced air oven to yield a first imaging member having a charge transport layer that was 25 microns thick.

Example 3

Charge Transport Layer 3

In a 1-ounce bottle was placed 1.3 grams of MAKROLON® polycarbonate [Bayer] and 11 grams of methylene chloride. The contents were agitated until fully dissolved. To the solution, added 0.4 grams N,N'-diphenyl-N,N-bis(3-methylphenyl)-1,1'-biphenyl-4,4'-diamine and 0.9 grams tri-[4-methylphenyl]amine (TTA) and 0.02 g UCARMAG® 537 (Union Carbide Corp.). The contents were agitated until fully dissolved. Using a member from Example 1, the solution was coated onto the charge-generating layer using a 4 mil Bird bar. The layer was dried at 100° C. for 30 minutes in a forced air oven to yield a first imaging member having a charge transport layer that was 25 microns thick.

Example 4

Charge Transport Layer 1

In a 1-ounce bottle was placed 1.3 grams of MAKRLON® polycarbonate from Bayer and 11 grams of methylene chloride. The contents were agitated until fully dissolved. To the solution was added 0.4 grams N,N'-diphenyl-N,N-bis(3-methylphenyl)-1,1'-biphenyl-4,4'-diamine and 0.9 grams tri-[4-methylphenyl]amine ("TTA") and 0.5 grams of 1,2,4-trichlorobenzene. The contents were agitated until fully dissolved. Using a member from Example 1, the solution was coated onto the charge-generating layer using a 4 mil Bird bar. The layer was dried at 100° C. for 30 minutes in a forced air oven to yield a first imaging member having a charge transport layer that was 25 microns thick.

Example 5

Overcoat Layer 1

An overcoat coating solution was formed by adding to a 240 milliliter bottle 80 grams 1-methoxy-2-propanol, 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N-diphenyl-N,N'-di[3-hydroxyphenyl]-biphenyldiamine (DHTPD), 5.5 grams of an 8 percent p-toluenesulfonic acid/2-propanol solution and 1.5 grams of SILCLEAN™ 3700 (a hydroxylated siliconized polyacrylate available from BYK-Chemie USA). The contents were stirred until a complete solution was obtained.

The photoconductor of Example 2 was overcoated with the above overcoat solution using a ⅛ mil Bird bar. The resultant overcoated film was dried in a forced air oven for 2 minutes at 125° C. to yield a 3-micron overcoat, which was substantially crosslinked and insoluble, or substantially insoluble in methanol or ethanol.

Example 6

Overcoat Layer 2

An overcoat coating solution was formed by adding to a 240 milliliter bottle 80 grams 1-methoxy-2-propanol, 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-biphenyldiamine (DHTPD), 5.5 grams of an 8 percent p-toluenesulfonic acid solution 12-propanol and 1.5 grams of SIL-CLEAN™ 3700 (a hydroxylated siliconized polyacrylate available from BYK-Chemie USA). The contents were stirred until a complete solution was obtained.

The photoconductor of Example 3 was overcoated with the above overcoat solution using a ⅛ mil Bird bar. The resultant overcoated film was dried in a forced air oven for 2 minutes at 125° C. to yield a 3 micron overcoat, which was substantially crosslinked and insoluble, or substantially insoluble in methanol or ethanol.

Example 7

Overcoat Layer 3

An overcoat coating solution was formed by adding to a 240 milliliter bottle 80 grams 1-methoxy-2-propanol, 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-biphenyldiamine (DHTPD), 5.5 grams of an 8 percent p-toluenesulfonic acid/2-propanol solution and 1.5 grams of SIL-CLEAN™ 3700 (a hydroxylated siliconized polyacrylate available from BYK-Chemie USA). The contents were stirred until a complete solution was obtained.

The photoconductor of Example 4 was overcoated with the above overcoat solution using a ⅛ mil Bird bar. The resultant overcoated film was dried in a forced air oven for 2 minutes at 125° C. to yield a 3-micron overcoat, which was substantially crosslinked and insoluble, or substantially insoluble in methanol or ethanol.

Example 8

Flatness Test

The flexible photoreceptor sheets prepared as described in Example 5, 6, and 7 were tested for flatness by placing them in an unrestrained condition on a flat surface. Photoreceptor device Nos. 5, 6 and 7 laid flat. No curl was observed in these flexible photoreceptor sheets.

The flexible photoreceptor sheets prepared as described in Example 5, 6, and 7 were tested for their xerographic sensitivity and cyclic stability.

For the xerographic sensitivity, or photosensitivity, each device was charged to an initial potential of −500V and then discharged by exposing them to 780 nm. The new surface potential was recorded at 320 ms after this exposure followed by the erase step, which is another exposure to dissipate the remaining surface charges. These steps, charging to −500V, exposure, reading of the surface potential, and erase were repeated for various levels of exposures to obtain the photo-induced discharge curve (PIDC) for each imaging member. The photosensitivity of an imaging member is usually provided in terms of the initial slope of the PIDC. They are rendered in Table 1. Another common measure of the sensitivity is the amount of exposure energy in ergs/cm$^2$, designated as $E_{1/2}$, required to achieve 50 percent photodischarge form the initial potential to half of its value. The higher the photosensitivity is, the smaller the $E_{1/2}$ value is. These values as well as the potential at an exposure of 10 ergs/cm$^2$ are rendered in Table 1.

Next, the devices were electrically cycled to examine their stability, i.e., repeatedly charged, exposed, and erased, for about 10,000 times. After this fatiguing, the PIDC were taken again as described above. The new parameters are also shown in Table 1 in the rows labeled "fatigued". The columns labeled with "Δ" are the differences between fatigued and initial values of the preceding columns. Table 1 demonstrates that all these devices show excellent sensitivity and adequate stability for xerographic applications.

TABLE 1

| Device | Condition | Potential [V] @ 10 ergs/cm$^2$ | Δ | Initial Slope [V · ergs/cm$^2$] | Δ | Exp. $E_{1/2}$ [ergs/cm$^2$] | Δ |
|---|---|---|---|---|---|---|---|
| Example 5 | Initial | 32 | 23 | 366 | 11 | 0.79 | 0.13 |
| | Fatigued | 55 | | 377 | | 0.92 | |
| Example 6 | Initial | 44 | 6 | 391 | −3 | 0.74 | 0.1 |
| | Fatigued | 50 | | 388 | | 0.84 | |
| Example 7 | Initial | 72 | 61 | 357 | 35 | 0.86 | 0.36 |
| | Fatigued | 133 | | 392 | | 1.22 | |

Example 9

Scratch Resistance Testing

Rq, which is the root mean square roughness, can be considered as the standard metric for the scratch resistance assessment with a scratch resistance of grade 1 representing poor scratch resistance and a scratch resistance of grade 5 representing excellent scratch resistance as measured by a surface profile meter. More specifically, the scratch resistance is grade 1 when the Rq measurement is greater than 0.3 microns; grade 2 for Rq between 0.2 and 0.3 microns; grade 3 for Rq between 0.15 and 0.2 microns; grade 4 for Rq between 0.1 and 0.15 microns; and grade 5 being the best or excellent scratch resistance when Rq is less than 0.1 microns.

The above prepared 4 photoconductive belts from Examples 2, 5, 6 and 7 were cut into strips of 1 inch in width by 12 inches in length, and were flexed in a tri-roller flexing system. Each belt was under a 1.1 lb/inch tension, and each roller was ⅛ inch in diameter. A polyurethane "spots blade" was placed in contact with each belt at an angle between 5 and 15 degrees. Carrier beads of about 100 micrometers in size diameter were attached to the spots blade by the aid of double-sided tape. These beads striked the surface of each of the belts as the belts rotated in contact with the spots blade for 200 simulated imaging cycles. The surface morphology of each scratched area was then analyzed.

All three belts from Examples 5, 6 and 7 demonstrated excellent scratch resistance of Rq less than 0.1 microns, whereas belt from Example 2 showed low scratch resistance of Rq greater than 0.3 microns.

Example 10

Machine Crack Testing

The above prepared 4 photoconductive belts from Examples 2, 5, 6 and 7 were cut into strips of 1 inch in width by 12 inches in length, and are flexed in a tri-roller flexing system. Each belt was under a 1.1 lb/inch tension and each roller was 0.5 inches in diameter. The belts were flexed for 10,000 cycles before being exposed to corona effluent for 15 minutes. Flexing life of a belt was defined as the number of cycles that the first delaminated crack can be visualized. The printable cracks occurred at the overcoat layer and ended at the interface with the substrate. No crack was found during 10,000 flexing cycles for samples from example 5 to 7. They all showed great improvement in extending photoreceptor life over sample from example 2 without the overcoat, in which numerous cracks were found well within 5,000 flexing cycles.

While the invention has been described in detail with reference to specific embodiments, it will be appreciated that various modifications and variations will be apparent to the artisan. All such modifications and embodiments as may readily occur to one skilled in the art are intended to be within the scope of the appended claims.

What is claimed is:

1. An imaging member comprising:

a substrate;

a charge generation layer;

a charge transport layer comprising a mixture comprising a polymer and charge transport components, wherein said mixture has a glass transition temperature of less than about 70° C.; and an overcoat comprising a crosslinked polymer network comprising a resin, charge transport molecules, crosslinking component, an acid catalyst and low surface component, and wherein the resin is a resin selected from the group consisting of polyol resins, said resin having crosslinking sites at a hydroxyl group, the charge transport molecule is crosslinkable charge transport, the crosslinking component is methoxy methylated melamine, and the low surface energy component is selected from the group consisting of hydroxy functionalized siloxane polyacrylate and is represented a formula selected from the group consisting of Formula I:

$$[HO—[R]_a]—[SiR_1R_2—O—]_n—[[R]_a—OH]_b;$$

wherein R represents an acrylate, element a represents the number of repeating R units and is from about 1 to about 100; $R_1$, and $R_2$ independently represent alkyl with from about 2 to about 20 carbons; n is a number of from about 5 to about 200; and b is 0 or 1.

2. An imaging member in accordance with claim 1, wherein said resin in said overcoat is crosslinkable.

3. An imaging member in accordance with claim 1, wherein said polyol resin in said overcoat is an acrylated polyol.

4. A coating composition according to claim 1, wherein the said crosslinking component is a melamine compound represented by

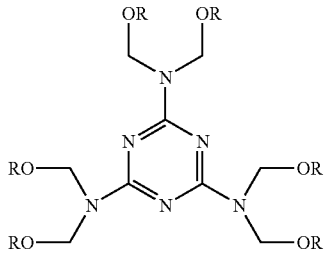

wherein R is selected from the group consisting of at least one of hydrogen, methyl, ethyl, propyl, and butyl.

5. A coating composition according to claim 1, wherein said crosslinking component is a melamine formaldehyde resin represented by

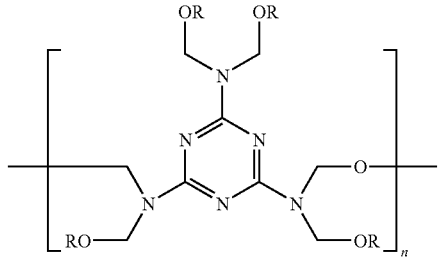

wherein R is selected from the group consisting of hydrogen, methyl, ethyl, propyl, butyl, and mixtures thereof; and n represents a number of repeating units of from about 1 to about 100.

6. An imaging member in accordance with claim 1, wherein said low surface energy component is present in said overcoat in an amount of from about 0.1 to about 10 percent by weight of total solids.

7. An imaging member in accordance with claim 1, wherein said charge transport components of said charge transport layer are selected from the group consisting of tri-[4-methylphenyl] amine, [N,N'-diphenyl-N,N'-bis3-[oxypentylethylcarboxylate] phenyl-4,4'-biphenyl-1,1' diamine, and mixtures thereof.

8. An imaging member in accordance with claim 1, wherein said polymer of said charge transport layer is a polycarbonate selected from the group consisting of poly(4,4'-isopropylidene-diphenylene) carbonate, poly(4,4'-cyclohexylidinediphenylene) carbonate, poly(4,4'-isopropylidene-3,3'-dimethyl-diphenyl) carbonate, and mixtures thereof.

9. An imaging member in accordance with claim 1, wherein said charge transport layer has a thickness of from about 10 to about 40 microns.

10. An imaging member in accordance with claim 1, wherein the glass transition temperature of said mixture in said charge transport layer is from about 20° C. to about 70° C.

11. An imaging member in accordance with claim 10, wherein the glass transition temperature of said mixture in said charge transport layer is from about 30° C. to about 50° C.

12. An imaging member comprising:

a flexible belt substrate;

a charge generation layer;

a charge transport layer comprising a mixture comprising a polymer and charge transport components, wherein said mixture has a glass transition temperature of less than about 70° C.; and an overcoat comprising a crosslinked polymer network comprising a resin, charge transport molecules, crosslinking component, an acid catalyst and a low surface component, and wherein the resin is a resin selected from the group consisting of polyol resins, said resin having crosslinking sites at a hydroxyl group, the charge transport molecule is crosslinkable charge transport, the crosslinking component is methoxy methylated melamine, and the low surface energy component is selected from the group consisting of hydroxy functionalized siloxane polyacrylate and is represented a formula selected from the group consisting of Formula I:

$$[HO—[R]_a]—[SiR_1R_2—O—]_n—[[R]_a—OH]_b;$$

wherein R represents an acrylate, element a represents the number of repeating R units and is from about 1 to about 100; $R_1$, and $R_2$ independently represent alkyl with from about 2 to about 20 carbons; n is a number of from about 5 to about 200; and b is 0 or 1.

13. An image forming apparatus for forming images on a recording medium comprising:

a) an imaging member comprising:

a flexible belt substrate;

a photogenerating layer;

a charge transport layer comprising a mixture comprising a polymer and charge transport components, wherein said mixture has a glass transition temperature of less than about 70° C.; and an overcoat comprising a crosslinked polymer network comprising a resin, charge transport molecules, crosslinking component, an acid catalyst and a low surface component, and wherein the resin is a resin selected from the group consisting of polyol resins, said resin having crosslinking sites at a hydroxyl group, the charge transport molecule is crosslinkable charge transport, the crosslinking component is methoxy methylated melamine, and the low surface energy component is selected from the group consisting of hydroxy functionalized siloxane polyacrylate and is represented a formula selected from the group consisting of Formula I:

$$[HO—[R]_a]—[SiR_1R_2—O—]_n—[[R]_a—OH]_b;$$

wherein R represents an acrylate, element a represents the number of repeating R units and is from about 1 to about 100; $R_1$, and $R_2$ independently represent alkyl with from about 2 to about 20 carbons; n is a number of from about 5 to about 200; and b is 0 or 1;

b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

* * * * *